US008043100B2

(12) United States Patent
Liao

(10) Patent No.: US 8,043,100 B2
(45) Date of Patent: Oct. 25, 2011

(54) PLUG STRUCTURE WITH ANGLE-ADJUSTING FUNCTION

(76) Inventor: Sheng-Hsin Liao, Shulin (TW)

( * ) Notice: Subject to any disclaimer, the term of this patent is extended or adjusted under 35 U.S.C. 154(b) by 422 days.

(21) Appl. No.: 12/420,185

(22) Filed: Apr. 8, 2009

(65) Prior Publication Data

US 2009/0284221 A1 Nov. 19, 2009

(30) Foreign Application Priority Data

May 19, 2008 (CN) ..... 2008 2 0115299 U

(51) Int. Cl.
*H01R 13/44* (2006.01)

(52) U.S. Cl. ..... 439/131

(58) Field of Classification Search ..... 439/131, 439/640, 171–175

See application file for complete search history.

(56) References Cited

U.S. PATENT DOCUMENTS

| | | | | |
|---|---|---|---|---|
| 4,386,333 | A * | 5/1983 | Dillan | 336/107 |
| 5,967,807 | A * | 10/1999 | Wu | 439/131 |
| 6,126,460 | A * | 10/2000 | Wu | 439/131 |
| 6,328,581 | B1 * | 12/2001 | Lee et al. | 439/106 |
| 6,457,984 | B1 * | 10/2002 | Montgomery et al. | 439/131 |
| 6,722,900 | B2 * | 4/2004 | Segawa et al. | 439/131 |
| 6,780,033 | B2 * | 8/2004 | Liu | 439/172 |
| 6,790,062 | B1 * | 9/2004 | Liao | 439/171 |
| 6,923,666 | B1 * | 8/2005 | Liao | 439/172 |
| 7,052,298 | B1 * | 5/2006 | Cheng | 439/171 |
| 7,354,286 | B1 * | 4/2008 | Lee | 439/172 |
| 7,381,067 | B2 * | 6/2008 | Sze | 439/131 |
| 7,445,513 | B1 * | 11/2008 | Lee | 439/652 |
| 7,481,660 | B1 * | 1/2009 | Tsai | 439/131 |
| 7,578,683 | B2 * | 8/2009 | Zijlstra | 439/131 |
| 7,601,023 | B1 * | 10/2009 | Ma et al. | 439/518 |
| 7,628,621 | B2 * | 12/2009 | Tsai | 439/131 |
| 2002/0119687 | A1 * | 8/2002 | Wen-Ching | 439/131 |
| 2002/0173183 | A1 * | 11/2002 | Segawa et al. | 439/131 |
| 2002/0182906 | A1 * | 12/2002 | Teng et al. | 439/131 |
| 2002/0187667 | A1 * | 12/2002 | Kitagawa et al. | 439/131 |
| 2004/0038572 | A1 * | 2/2004 | Liu | 439/172 |
| 2004/0097114 | A1 * | 5/2004 | Shiroshita et al. | 439/174 |
| 2006/0019519 | A1 * | 1/2006 | Son | 439/131 |
| 2006/0110963 | A1 * | 5/2006 | Cheng | 439/171 |
| 2006/0281349 | A1 * | 12/2006 | Chong | 439/131 |

* cited by examiner

*Primary Examiner* — Tulsidas C Patel
*Assistant Examiner* — Vladimir Imas
(74) *Attorney, Agent, or Firm* — Muncy, Geissler, Olds & Lowe, PLLC

(57) ABSTRACT

A plug structure with angle-adjusting function includes a main body, an adjusting mechanism, a plurality of inserting elements and a power cord. The adjusting mechanism has a push button and a plurality of rotary elements. The push button is movably disposed in the main body, the rotary elements are rotatably received in the main body, the push button has a guiding groove, each rotary element has at least two axle portions, and the axle portions of the rotary element are received in the guiding groove. The inserting elements are respectively fixed on the rotary elements, and each inserting element has a front side exposed outside the main body. The power cord electrically connects to the inserting elements. Therefore, the two inserting elements can be selectably inserted into two types of socket by matching the push button of the adjusting mechanism and the special design of the rotary elements.

18 Claims, 8 Drawing Sheets

PLUG STRUCTURE WITH ANGLE-ADJUSTING FUNCTION

BACKGROUND OF THE INVENTION

1. Field of the Invention

The present invention relates to a plug structure with angle-adjusting function, and particularly relates to a plug structure having inserting elements selectably inserted into two types of socket with the same standard.

2. Description of Related Art

In the prior art, an electronic device has a power cord, and the power cord has a plug. When the plug inserts into a socket, a power source can be supplied to the electronic device via the power cord. If the standards of the plug and the socket are different, an adapter needs to be applied to the plug. In other words, when the standards of the plug and the socket are different, the plug with one standard can be inserted into the socket with another standard via the adapter.

However, one type of adapter is corresponding to one type of socket, so that the plug needs to use different adapters according to different sockets with different standards. Hence, it is inconvenient for users to uses many different types of adapter to conform to different types of socket. For factory owner, it would waste cost to manufacture many kinds of adapter.

SUMMARY OF THE INVENTION

One particular aspect of the present invention is to provide a plug structure with angle-adjusting function. The plug structure has inserting elements that can be selectably inserted into two types of socket with the same standard. In addition, the cost of the present invention is reduced.

In order to achieve the above-mentioned aspects, the present invention provides a plug structure with angle-adjusting function, including: a main body, an adjusting mechanism, a plurality of inserting elements and a power cord. The adjusting mechanism has a push button and a plurality of rotary elements. The push button is movably disposed in the main body, the rotary elements are rotatably received in the main body, the push button has a guiding groove, each rotary element has at least two axle portions, and the axle portions of the rotary element are received in the guiding groove of the push button. The inserting elements are respectively fixed on the rotary elements, and each inserting element has a front side exposed outside the main body. The power cord is electrically connected to the inserting elements.

Therefore, the usage angle of the two inserting elements is adjustable (the angle relationship between the two inserting elements is adjustable) by matching the push button of the adjusting mechanism and the special design of the rotary elements, so that the two inserting elements of the plug structure can be selectably inserted into two types of socket with the same standard. In addition, the cost of the present invention is reduced.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objectives and advantages of the present invention will be more readily understood from the following detailed description when read in conjunction with the appended drawings, in which.

DETAILED DESCRIPTION OF THE PREFERRED EMBODIMENTS

Figure 1:
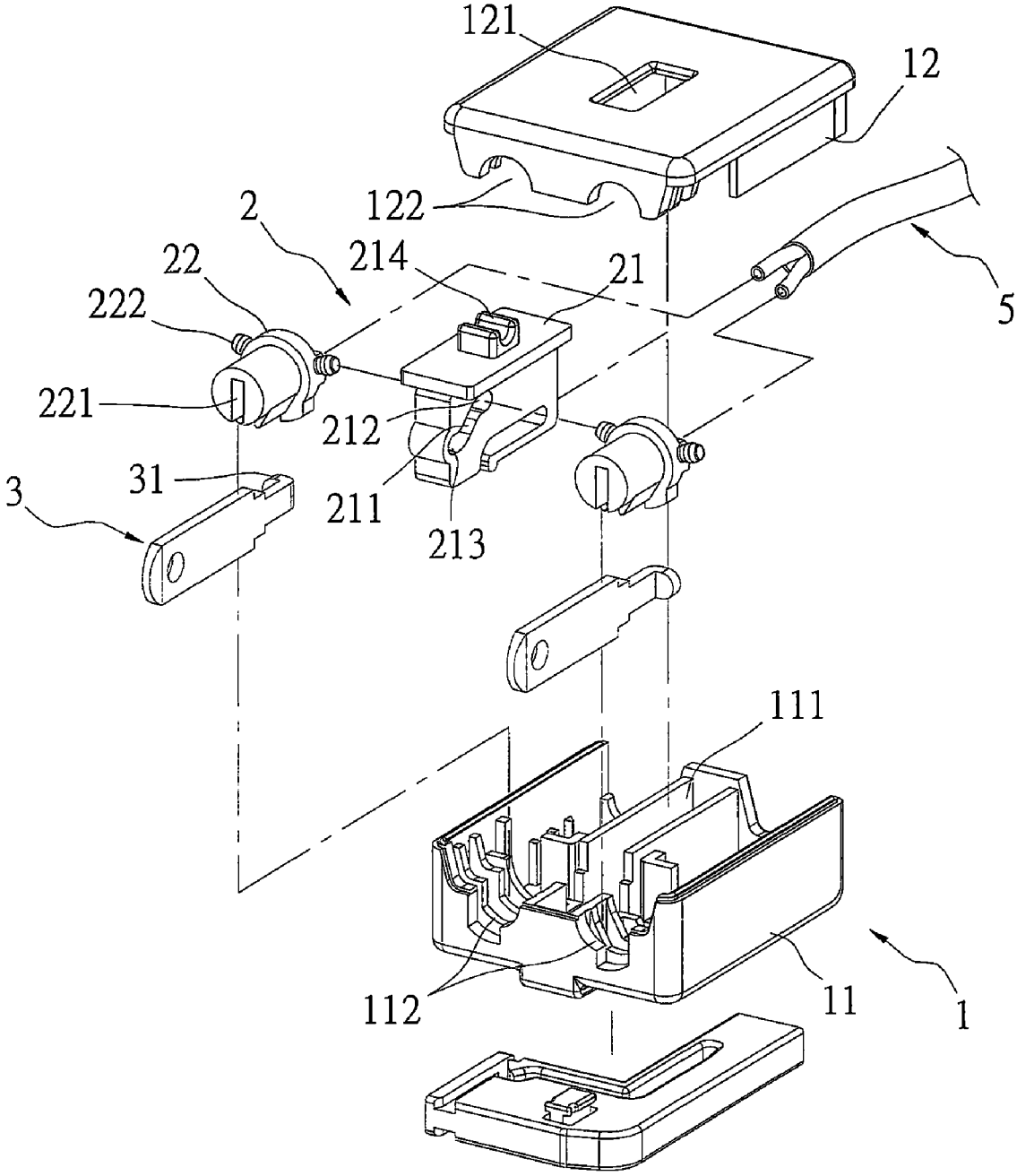
FIG. 1 is a perspective, exploded view of a plug structure according to first embodiment.
Figure 2:
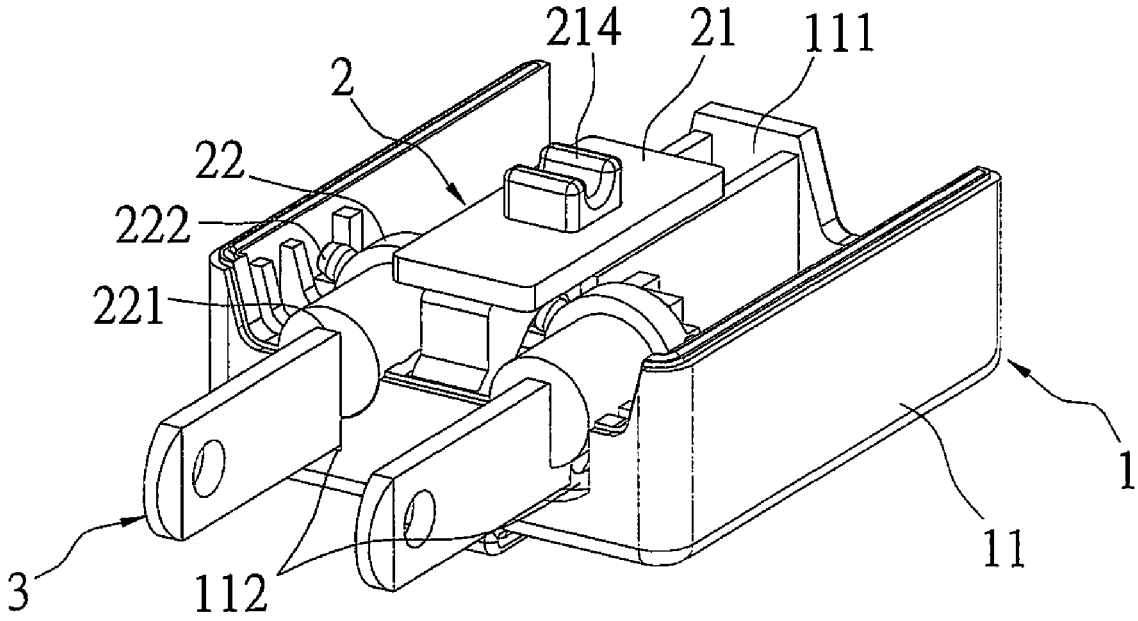
FIG. 2 is a partial, perspective, assembled view of a plug structure according to first embodiment of the present invention.

Referring to FIGS. 1 to 4, the present invention provides a plug structure with angle-adjusting function, including: a main body 1, an adjusting mechanism 2, and two inserting elements 3. The main body 1 has a base seat 11 and a cover 12. The base seat 11 is made of plastic material, the base seat 11 is a hollow casing, and the base seat 11 has a concave sliding groove 111 formed on its central portion. The sliding groove 111 extends forwards and backwards along the base seat 11. The base seat 11 has two concave first receiving space 112 formed on its front side. The two first receiving spaces 112 are positioned in front of two locations that are respectively located beside two sides of sliding groove 111.

The cover 12 is made of plastic material. The cover 12 has an opening groove 121 passing through thereof. The opening groove 121 extends forwards and backwards along the cover 12. The cover 12 has two concave second receiving space 122 formed on its front side. The two second receiving spaces 122 respectively correspond to the first receiving space 112 in order to receiving rotatable elements 22.

The adjusting mechanism 2 has a push button 21 and two rotary elements 22. The push button 21 and the two rotary elements 22 are made of plastic material. The push button 21 has a guiding groove 211 passing therethrough. The guiding groove 211 has a first groove 212 and a second groove 213, and the height of the first groove 212 is different from the height of the second groove 213. The push button 21 has a protrusion portion 214 projected upwards therefrom. The push button 21 is moved forwards and backwards in the sliding groove 111 of the base seat 11 of the main body 1.

The two rotary elements 22 are symmetrical and are similar to column shape. Each rotary element 22 has an insert groove 221 formed inwards along an axial direction. Each rotary element 22 has two symmetrical axle portions 222 respectively disposed on its two lateral sides. The two rotary elements 22 are respectively rotatably received in the two first receiving spaces 112 of the base seat 11. One of the two axle portions 222 of each rotary element 22 is received in the guiding groove 211. The two rotary elements 22 are rotated by the push button 21.

The two inserting elements 3 are made of metal material with good electric conductivity. The two inserting elements 3 are symmetrical and are similar to flat-pin shape. Each inserting element 3 has a conductive portion 31 extending outwards from its rear side. The two conductive portions 31 of the two inserting elements 3 are electrically connected to a power cord 5 by soldering. One part of each inserting element 3 is fixedly inserted into the insert groove 221 of each rotary element 22, and each inserting element 3 has a front side and a rear side both exposed outside each corresponding rotary element 22.

When the adjusting mechanism 2 and the two inserting elements 3 are assembled in the base seat 11 of the main body 1, the cover 12 and the base seat 11 are combined together by retaining or screwing. Hence, the two second receiving spaces 122 are correspondingly matched with the first receiving spaces 112 in order to receive the two rotary elements 22. The two front sides of the two inserting elements 3 are extended outside the base seat 11 and the cover 12 of the main body 1. The protrusion portion 214 of the push button 21 is disposed in the opening groove 121 of the cover 12, so that a user can push the push button 21 to move forwards and backwards.

Figure 3:
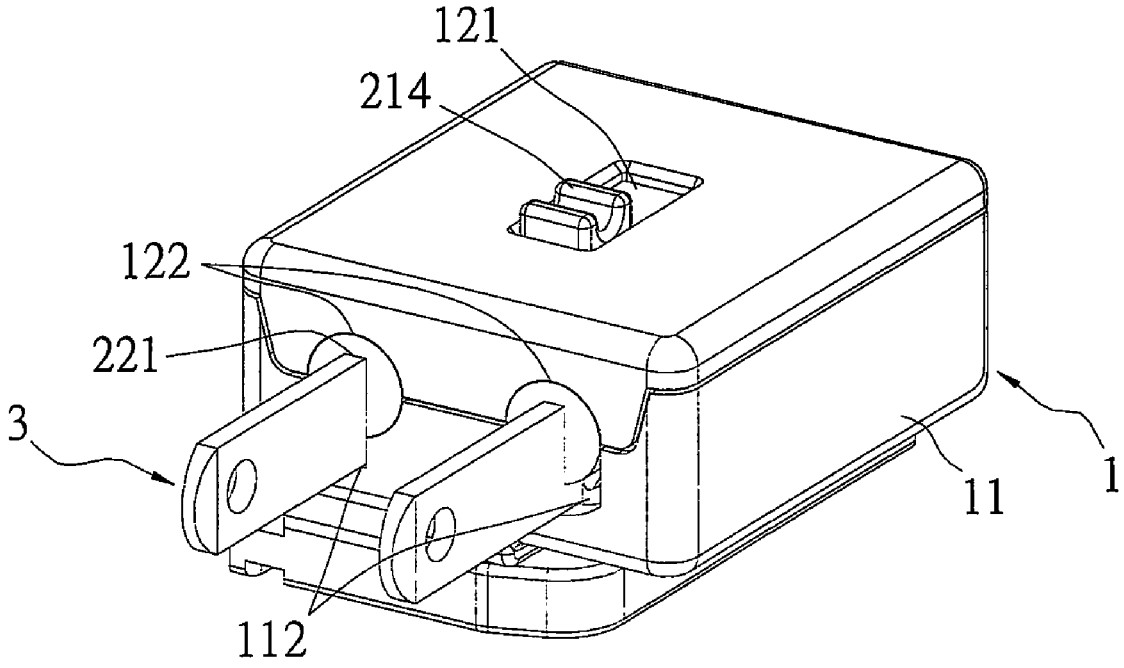
FIG. 3 is a perspective, assembled view of a plug structure according to first embodiment of the present invention.
Figure 4:
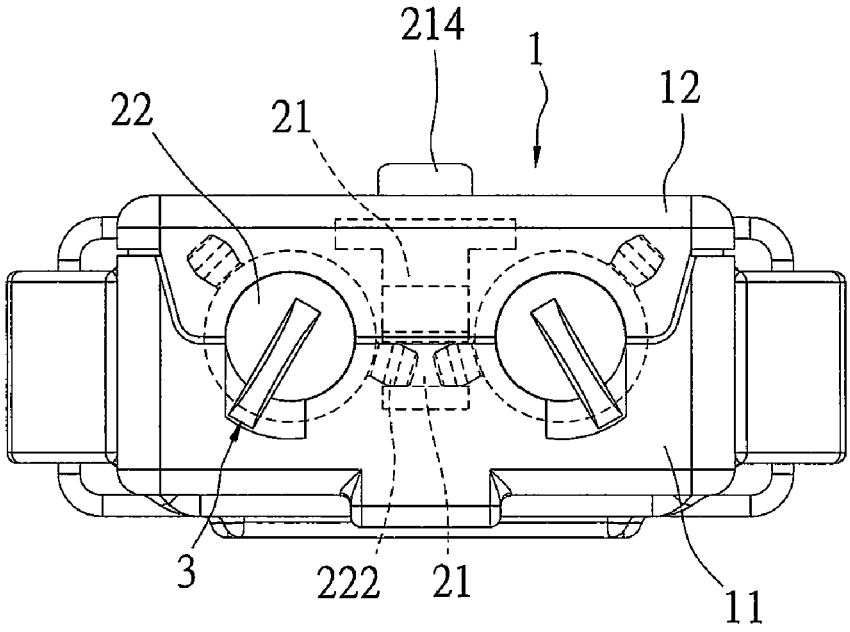
FIG. 4 is one front view of a plug structure in using according to first embodiment of the present invention.
Figure 5:
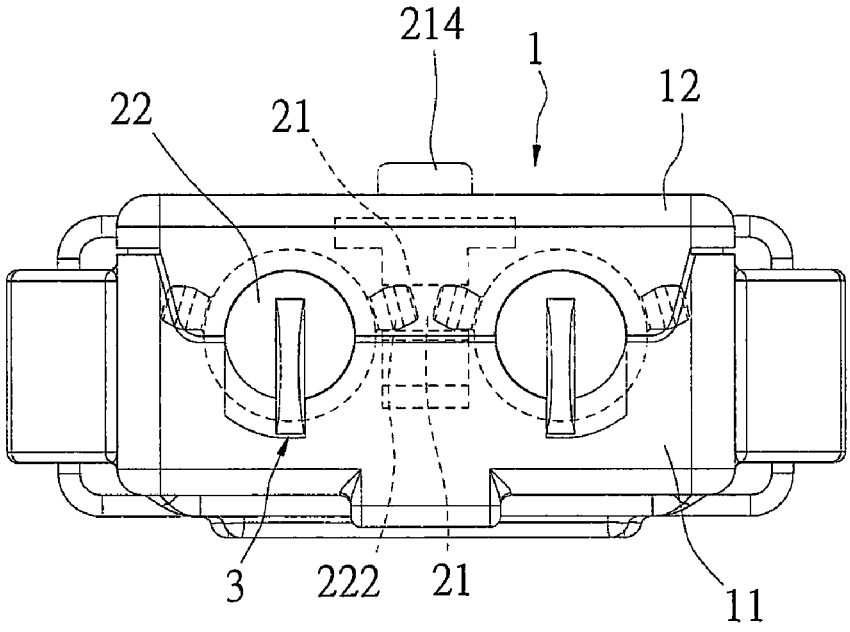
FIG. 5 is another front view of a plug structure in using according to first embodiment of the present invention.

Referring to FIGS. 3 to 5, when the plug structure of the present invention wants to insert into a socket (not shown) with two flat holes and the two axle portions 222 of the two rotary elements 22 are disposed in the first groove 212, the two inserting elements 3 are parallel to each other (as shown in FIG. 5). Hence, the two inserting elements 3 can be inserted directly into the two flat holes of the socket. When the plug structure of the present invention wants to insert into a socket (not shown) with two flat holes that are inclined to each other, the user can manually push the protrusion 214 in order to push the push button 21 to move. Hence, the two axle portions 222 are moved gradually to the second groove 213 (the two axle portions 222 are moved downwards from the first groove 214 to the second groove 213), so that the two inserting elements 3 are rotated to be inclined to each other by clockwise or counterclockwise rotating the two rotary elements 22 (as shown in FIG. 4). Hence, the two inclined inserting elements 3 can be inserted directly into the two inclined flat holes of the socket.

Figure 6:
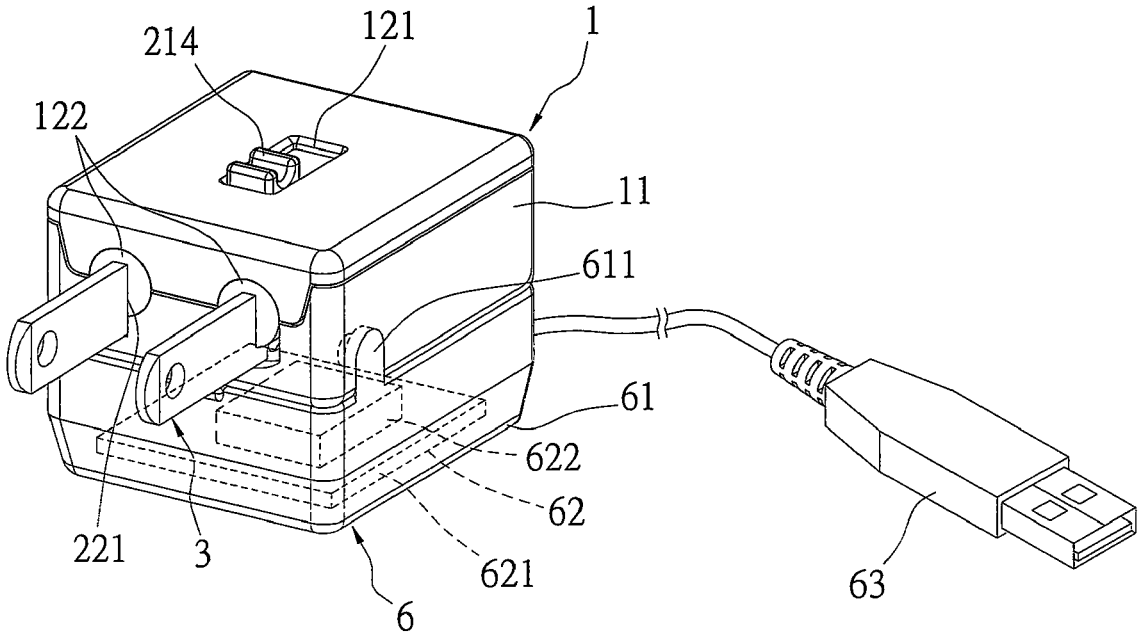
FIG. 6 is a perspective, assembled view of a plug structure combined with a batter charger according to first embodiment of the present invention.

Referring to FIG. 6, the plug structure of the present invention can combine with a battery charger 6. The battery charger 6 includes a shell 61, a circuit unit 62 and an electrical connector 63. The shell 61 is hollow. The circuit unit 62 is received in the shell 61. The circuit unit 62 has a PCB 621 and an electronic element 622 (such as charging IC, resistance and capacitance) electrically disposed on the PCB 621. The circuit unit 62 is electrically connected with the two inserting elements 3. The electrical connector 63 is a male plug or a female plug. The electrical connector 63 has one side exposed outside the shell 61 and another side electrically connected to the circuit unit 62. The electrical connector 63 can be a male connector (such as USB connector), or a DC male plug or a DC female plug etc.

The shell 61 is combined with one side of the main body 1 by retaining or screwing; alternatively, the shell 61 has two pivot portions 611 disposed on its two lateral edges. The shell 61 is pivoted on the base seat 11 of the main body 1 by the two pivot portions 611, so that the shell 61 can be rotated upwards or downwards. When the electrical connector 63 inserts into an electronic device (not shown) such as cell phone or PDA etc., the plug structure of the present invention can be inserted into a socket for charging the electronic device by using the circuit unit 62 of the battery charger 6 to change voltage.

Figure 7:
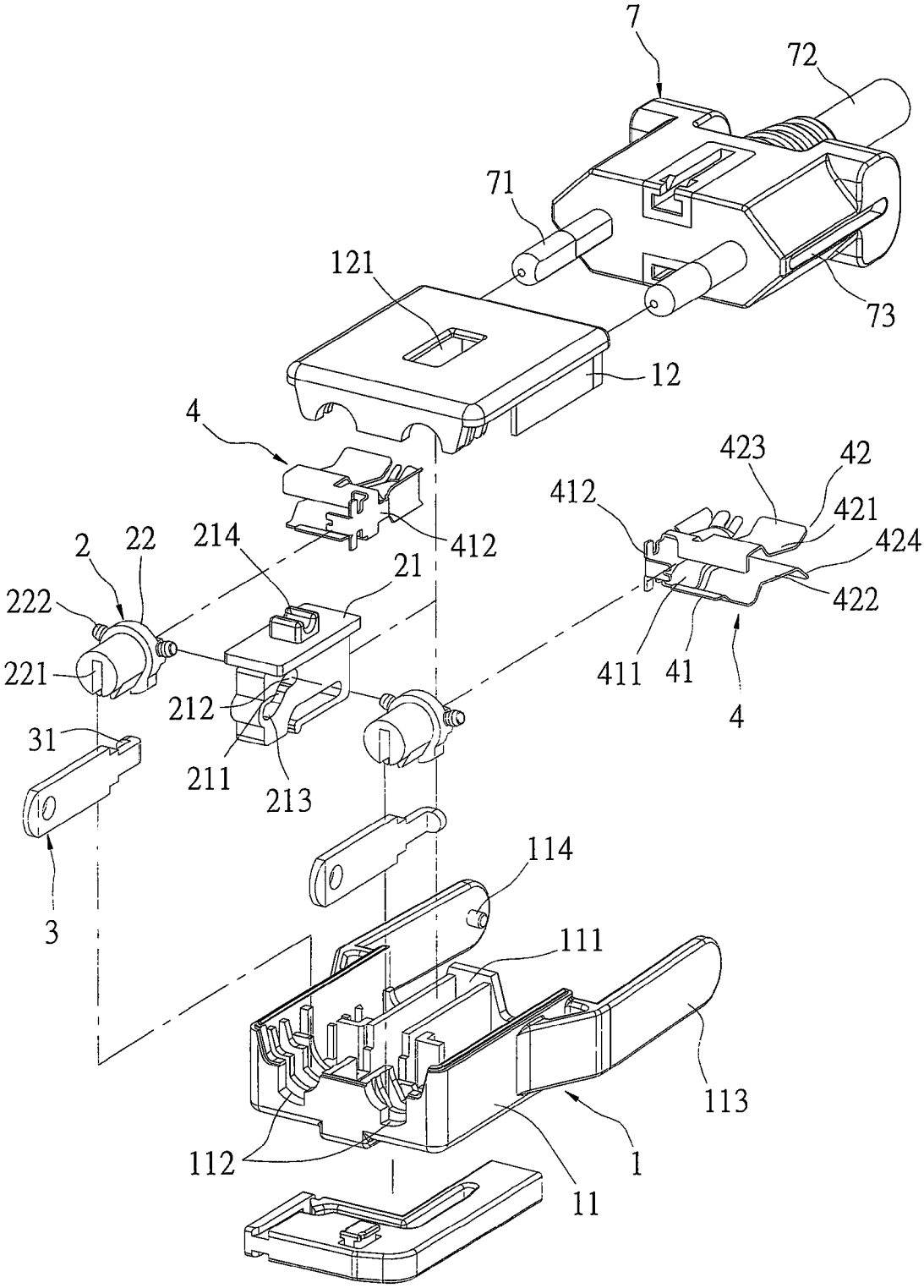
FIG. 7 is a perspective, exploded view of a plug structure according to second embodiment of the present invention.
Figure 8:
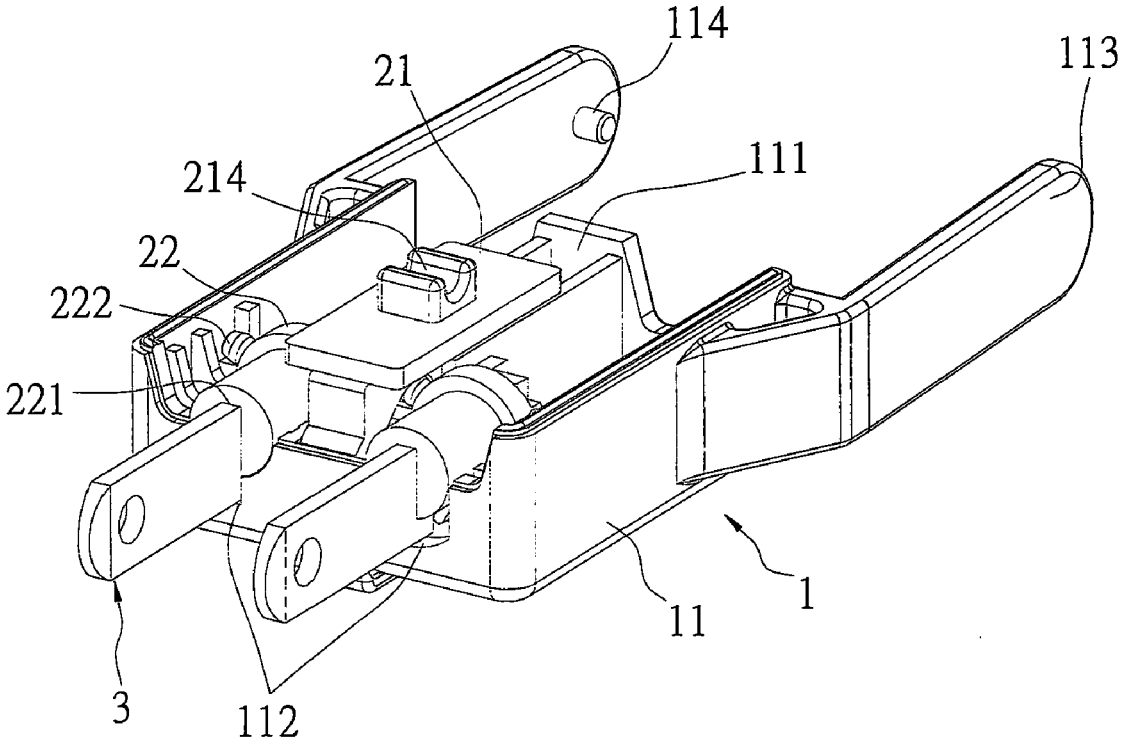
FIG. 8 is a partial, perspective, assembled view of a plug structure according to second embodiment of the present invention.
Figure 9:
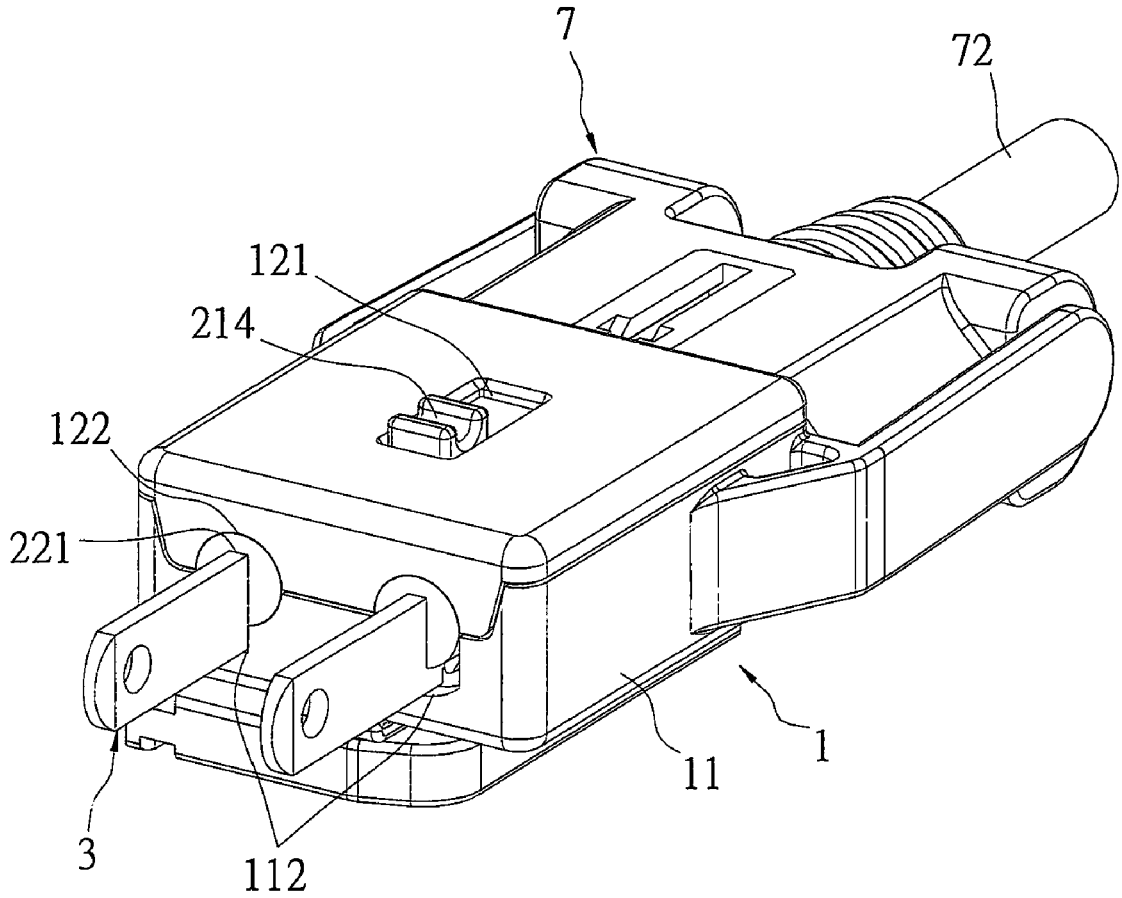
FIG. 9 is a perspective, assembled view of a plug structure according to second embodiment of the present invention.

Referring to FIGS. 7 to 9, an adapting plug structure is disclosed. The difference between the plug structure and the adapting plug structure is that: the base seat 11 of the main body 1 has two lateral arms 113 integrally combined with two lateral edges of the base seat 11. Alternatively, the two lateral arms 113 can be pivoted on the two lateral edges of the base seat 11, so that the two lateral arms 113 can be rotated. Each lateral arm 113 has a post 114 disposed on its inner lateral face.

The adapting plug structure includes two conductive elements 4 that are symmetrical and are made of metal material with good electric conductivity. Each conductive element 4 has a fixing portion 41 and a clipping portion 42. The fixing portion 41 has a bottom plate 411 and a lateral plate 412 extending upwards from one side of the bottom plate 411. The clipping portion 412 has a first clipping piece 421 and a second clipping piece 422 respectively extending from the lateral plate 412 and the bottom plate 411. The first clipping piece 421 and the second clipping piece 422 are two symmetrical plate structures. The first clipping piece 421 is disposed above the second clipping piece 422 and is separated from the second clipping piece 422 by a predetermined distance. The first clipping piece 421 and the second clipping piece 422 both extend backwards by a predetermined distance, so that two ends of the first clipping piece 421 and the second clipping piece 422 are two free ends. Two guiding portions (423, 424) are respectively bent outwards from the two rear sides of the first clipping piece 421 and the second clipping piece 422 in order to guide each pin 71 of a plug 7 to insert between the two guiding portions (423, 424) of each conductive element 4.

The two conductive elements 4 are respectively received beside two sides of the sliding groove 111 of the base seat 11 of the main body 1. The fixing portion 41 of each conductive element 4 is fixed on the base seat 11 of the main body by retaining, screwing, riveting or fusing etc., and the two clipping portions 42 face the rear area. The two conductive elements 4 directly contact with the two conductive portions 31 of the two inserting elements; alternatively, the two conductive elements 4 are electrically connected with the two conductive portions 31 of the two inserting elements by wire-bonding.

The present invention provides a plug 7 that can inserts into the plug structure. The plug 7 has two pins 71 disposed on its front side and a power cord 72 disposed on its rear side, and the two pins 71 are electrically connected to the power cord 72. The plug 7 has two sliding grooves 73 formed inwards on its two sides. The plug 7 is detachably assembled with the main body 1. The two posts 114 are respectively received in the sliding grooves 73. Therefore, the plug 7 is moved frontwards or backwards between the two lateral arms 113 by matching the posts 114 and the sliding grooves 73, so that the two pins 71 are movably inserted into the main body 1 and are clipped between the clipping portions 42 of the two conductive elements 4 in order to electrically connected the plug 7 with the two inserting elements 3.

When user does not want to use the plug 7, the two pins 71 of the plug 7 can separate from the conductive elements 4 by matching the posts 114 and the sliding grooves 73. In addition, the plug 7 can be slidably moved between the two lateral arms 113 and can be rotated by different angles, so that the plug 7 can be used independently without being detached from the main body 1.

The posts 114 and the two sliding groove 73 can be exchanged each other. In other words, two sliding grooves (not shown) can be formed on the two lateral arms 113, and two posts (not shown) can be disposed on the two sides of the plug 7, above-mentioned exchange method can achieve the same function. In addition, the number of the rotary element 22, the inserting element 3 and the conductive element 4 can be more than two such as three.

In conclusion, the usage angle of the two inserting elements 3 is adjustable (the angle relationship between the two inserting elements 3 is adjustable) by matching the push button 21 of the adjusting mechanism 2 and the special design of the rotary elements 22, so that the two inserting elements 3 of the plug structure can be selectably inserted into two types of socket with the same standard. In addition, the cost of the present invention is reduced.

Although the present invention has been described with reference to the preferred best molds thereof, it will be understood that the present invention is not limited to the details thereof. Various substitutions and modifications have been suggested in the foregoing description, and others will occur to those of ordinary skill in the art. Therefore, all such substitutions and modifications are intended to be embraced within the scope of the present invention as defined in the appended claims.

What is claimed is:

1. A plug structure with angle-adjusting function, comprising:

a main body;

an adjusting mechanism having a push button and a plurality of rotary elements, wherein the push button is movably disposed in the main body, the rotary elements are rotatably received in the main body, the push button has a guiding groove, each rotary element has at least two axle portions, and the axle portions of the rotary element are received in the guiding groove of the push button;

a plurality of inserting elements respectively fixed on the rotary elements, wherein each inserting element has a front side exposed outside the main body; and a power cord electrically connected to the inserting elements.

2. The plug structure as claimed in claim 1, wherein the main body has a base seat and a cover, the cover and the base seat are combined together, the base seat has a sliding groove formed on its inner portion, and the push button is movably disposed in the sliding groove of the base seat.

3. The plug structure as claimed in claim 2, wherein the base seat has two first receiving spaces formed on its front side, the cover has two second receiving spaces formed on its front side, and the two second receiving spaces are correspondingly matched with the first receiving spaces in order to receive the rotary elements.

4. The plug structure as claimed in claim 2, wherein the push button has a protrusion portion projected upwards therefrom, the cover has an opening groove passing through thereof, and the protrusion portion is disposed in the opening groove.

5. The plug structure as claimed in claim 1, wherein the guiding groove passes through the push button, the guiding groove has a first groove and a second groove, and the height of the first groove is different from the height of the second groove.

6. The plug structure as claimed in claim 1, wherein each rotary element has an insert groove, each inserting element is fixed inserted into the insert groove of each rotary element, and each inserting element has a front side and a rear side both exposed outside each corresponding rotary element.

7. The plug structure as claimed in claim 1, wherein each inserting element has a conductive portion extending outwards from its rear side, and the conductive portions of the inserting elements are electrically connected to the power cord.

8. The plug structure as claimed in claim 1, further comprising a battery charger, wherein the battery charger includes a shell, a circuit unit and an electrical connector, the circuit unit is received in the shell, the circuit unit has a printed circuit board and an electronic element electrically disposed on the printed circuit board, the circuit unit is electrically connected with the inserting elements, the electrical connector is electrically connected to the circuit unit, and the shell is combined with one side of the main body.

9. A plug structure with angle-adjusting function, comprising:

a main body;

an adjusting mechanism having a push button and a plurality of rotary elements, wherein the push button is movably disposed in the main body, the rotary elements are rotatably received in the main body, the push button has a guiding groove, each rotary element has at least two axle portions, and the axle portions of the rotary element are received in the guiding groove of the push button;

a plurality of inserting elements respectively fixed on the rotary elements, wherein each inserting element has a front side exposed outside the main body; and a plurality of conductive elements each having a fixing portion and a clipping portion, wherein the fixing portions of the conductive elements are fixed in the main body, and the conductive elements are electrically connected with the inserting elements.

10. The plug structure as claimed in claim 9, wherein the fixing portion has a bottom plate and a lateral plate extending upwards from one side of the bottom plate, the clipping portion has a first clipping piece and a second clipping piece respectively extending from the lateral plate and the bottom plate, the first clipping piece is disposed above the second clipping piece, and the first clipping piece and the second clipping piece both extend backwards to form two free ends.

11. The plug structure as claimed in claim 9, wherein the main body has a base seat and a cover, the cover and the base seat are combined together, the base seat has a sliding groove formed on its inner portion, and the push button is movably disposed in the sliding groove of the base seat.

12. The plug structure as claimed in claim 11, wherein the base seat has two first receiving spaces formed on its front side, the cover has two second receiving spaces formed on its front side, and the two second receiving spaces are correspondingly matched with the first receiving spaces in order to receive the rotary elements.

13. The plug structure as claimed in claim 11, wherein the push button has a protrusion portion projected upwards therefrom, the cover has an opening groove passing through thereof, and the protrusion portion is disposed in the opening groove.

14. The plug structure as claimed in claim 9, wherein the guiding groove passes through the push button, the guiding groove has a first groove and a second groove, and the height of the first groove is different from the height of the second groove.

15. The plug structure as claimed in claim 9, wherein each rotary element has an insert groove, each inserting element is fixed inserted into the insert groove of each rotary element, and each inserting element has a front side and a rear side both exposed outside each corresponding rotary element.

16. The plug structure as claimed in claim 9, wherein each inserting element has a conductive portion extending outwards from its rear side, and the conductive portions of the inserting elements are electrically connected to the conductive elements.

17. The plug structure as claimed in claim 9, further comprising a battery charger, wherein the battery charger includes a shell, a circuit unit and an electrical connector, the circuit unit is received in the shell, the circuit unit has a printed circuit board and an electronic element electrically disposed on the printed circuit board, the circuit unit is electrically connected with the inserting elements, the electrical connector is electrically connected to the circuit unit, and the shell is combined with one side of the main body.

18. The plug structure as claimed in claim 9, further comprising: another plug that has a plurality of pins disposed on its front side, wherein the plug has two sliding grooves formed inwards on its two sides, the main body has two lateral arms, each lateral arm has a post disposed on its inner lateral face, the posts are respectively received in the sliding grooves, so that the plug is moved frontwards or backwards between the two lateral arms by matching the posts and the sliding grooves, and the pins are movably inserted into the main body and are clipped between the clipping portions of the conductive elements.

* * * * *